US009157452B2

(12) United States Patent
Sadi

(10) Patent No.: US 9,157,452 B2
(45) Date of Patent: Oct. 13, 2015

(54) RADIAL FAN WHEEL, FAN UNIT AND RADIAL FAN ARRANGEMENT

(75) Inventor: Omar Sadi, Hall-Hessential (DE)

(73) Assignee: ZIEHL-ABEGG SE, Künzelsau (DE)

( * ) Notice: Subject to any disclaimer, the term of this patent is extended or adjusted under 35 U.S.C. 154(b) by 665 days.

(21) Appl. No.: 10/547,121

(22) PCT Filed: Mar. 4, 2004

(86) PCT No.: PCT/EP2004/002215

§ 371 (c)(1),
(2), (4) Date: May 26, 2006

(87) PCT Pub. No.: WO2004/079201

PCT Pub. Date: Sep. 16, 2004

(65) Prior Publication Data

US 2006/0228212 A1 Oct. 12, 2006

(30) Foreign Application Priority Data

Mar. 4, 2003 (EP) ..... 03004821

(51) Int. Cl.
*F04D 29/30* (2006.01)
*F04D 29/44* (2006.01)
*F04D 29/28* (2006.01)

(52) U.S. Cl.
CPC ..... *F04D 29/442* (2013.01); *F04D 29/282* (2013.01)

(58) Field of Classification Search
CPC ..... F04D 29/282; F04D 29/442
USPC ..... 416/185, 186 R, 188, 223 B, 238, 243, 416/DIG. 2; 415/203, 204, 206, 220, 223
See application file for complete search history.

(56) References Cited

U.S. PATENT DOCUMENTS 1,447,915 A 3/1923 Watkins
1,484,597 A * 2/1924 Watkins ..... 417/364
2,916,199 A * 12/1959 Loehr ..... 416/186 R
3,272,429 A * 9/1966 Wood ..... 416/186 R (Continued)

FOREIGN PATENT DOCUMENTS

DE 1 145 927 B 3/1963
DE 2437001 A1 * 2/1976 ..... 416/186 R (Continued)

OTHER PUBLICATIONS

Bommes, Leonhard, et al., 2nd ed. (2003) pp. 257-273, "Ventilatoren," Vulkan-Verlag, Essen, Germany.

(Continued)

*Primary Examiner* — Christopher Verdier
(74) *Attorney, Agent, or Firm* — Frost Brown Todd LLC

(57) ABSTRACT

A radial fan wheel comprising vanes (2) which are inclined against the rotational direction (8) (radial impeller inclined towards the rear), the outer edge regions (14, 7) of the top and bottom disks (3,4) projecting past the effective diameter (DAs) of the vanes. The diffusion space thus established between the bottom and top disks (1,3) and the effective and outer diameter (Das, DN) of the vanes enables the kinetic energy of the fluid to be effectively converted into static pressure). The cross-section of the diffusion space is thus embodied in such a way that it expands radially outwards in a rectangular or trapezoidal manner

8 Claims, 3 Drawing Sheets

(56) References Cited

U.S. PATENT DOCUMENTS

| | | | | |
|---|---|---|---|---|
| 4,092,088 | A * | 5/1978 | Nemesi | 417/360 |
| 5,209,639 | A * | 5/1993 | Neuber et al. | 415/213.1 |
| 5,336,050 | A | 8/1994 | Guida et al. | |
| 6,039,539 | A | 3/2000 | Berg | |
| 6,976,828 | B2 * | 12/2005 | Godichon et al. | 416/183 |
| 2002/0057967 | A1 * | 5/2002 | Eimer et al. | 415/204 |

FOREIGN PATENT DOCUMENTS

| | | | | |
|---|---|---|---|---|
| DE | 25 30 742 | | 1/1977 | |
| DE | 3919111 | A1 * | 1/1990 | 406/186 R |
| DE | 42 22 131 | A | 1/1994 | |
| DE | 19703292 | | 8/1998 | |
| EP | 0 848 788 | | 6/1998 | |
| EP | 1 039 142 | A | 9/2000 | |
| FR | 1355428 | A * | 2/1964 | 416/186 R |
| GB | 608703 | A * | 9/1948 | 416/186 R |
| GB | 1 196 488 | A | 1/1970 | |
| GB | 1589307 | | 5/1981 | |
| JP | 55-125396 | A * | 9/1980 | 416/186 R |
| JP | 06299993 | A | 10/1994 | |
| WO | WO 97/09535 | | 3/1997 | |
| WO | WO 2004/074864 | | 9/2004 | |
| WO | WO 2004/079201 | | 9/2004 | |

OTHER PUBLICATIONS

Eck, Bruno, "Ventilatoren," 5th ed. (1972) pp. 234,236 Springer-Verlag, Germany.

Draxler, Daniel, Siepert, Hein: "Entwurfsverfahren Zur opitmalen-Gestal-tung von Radialventilatoren", in : HLH-Luftung/Klima, Heizung/Sanitar, Gebaudetechnick, No. Apr. 2001,pp. 36-43.

Ziehl-Abegg; brochure 00283601 DL5.3-02/99, pp. 22/23

Bommes, Leonhard, et al.: "Ventilatoren", Vulkan-Verlag, 2nd ed., 2003, pp. 114-115 and 138.

Bommes, Leonhard, et al.: "Ventilatoren", Vulkan-Verlag, 2nd ed, 2003, p. 349.

Bommes, Leonhard, et al.: "Ventilatoren", Vulkan-Verlag, 1994, pp. 421-427, 498-501.

Eck, Dr.-Ing Bruno, et al.: "FANS Design and Operation of Centrifugal, Axial-Flow and Cross-Flow Fans", 1973, pp. 217-219, Pergamon Press, New York.

Schlender, Klingenberg: "Ventilatoren im Einsatz", VDI-Verlag 1996, pp. 10-13.

Opposition dated Feb. 16, 2011, filed by Nicotra Gebhardt GmbH against European Patent No. 1608875.

Machine Translation of Opposition dated Feb. 16, 2011, filed by Nicotra Gebhardt GmbH against European Patent No. 1608875.

Opposition dated May 5, 2011, filed by Flakt Woods Oy against European Patent No. 1608875.

Opposition dated Sep. 2, 2011, filed by ebm-papst Mulfingen GmbH & Co. KG against European Patent No. 1608875.

Machine Translation of Opposition dated Sep. 2, 2011, filed by ebm-papst Mulfingen GmbH & Co. KG against European Patent No. 1608875.

Oppostion dates Sep. 16, 2011, filed by Punker GmbH against European Patent No. 1608875.

Machine Translation of Opposition dates Sep. 16, 2011, filed by Punker GmbH against European Patent No. 1608875

Opposition dated Sep. 21, 2011, filed by Hanning Elektro-Werke GmbH & Co, KG against European Patent No. 1608875.

Machine Translation of Opposition dated Sep. 21, 2011, filed by Hanning Elektro-Werke GmbH & Co. KG against European Patent No. 1608875.

Opposition dated Sep 22, 2011, filed by CO.ME.DRI. SpA against European Patent No. 1608875.

* cited by examiner

RADIAL FAN WHEEL, FAN UNIT AND RADIAL FAN ARRANGEMENT

FIELD OF THE INVENTION

The invention pertains to a radial fan wheel with vanes inclined towards the rear, a fan unit and a radial fan arrangement.

BACKGROUND OF THE INVENTION

Such radial fan wheels or radial impellers are employed, for instance, in climate control and ventilation technology.

Radial impellers inclined towards the front having 30-40 vanes that run from the inside to the outside in the direction of rotation, with diameters of 160-400 mm, are employed in ventilation technology in conjunction with flow-shaping spiral housings. Their static efficiency is roughly 30-35%. Such a radial impeller is known from JP 06299993. U.S. Pat. No. 1,447,915 shows a design as a radial ventilator with a converging annular discharge, in which the centrifugally accelerated air is further accelerated by the outlet nozzle that converges radially on the outside.

For larger volume flows, radial impellers inclined towards the rear, in which the vanes are inclined against the direction of rotation, are predominantly used. The usual diameters run between 200 and 1500 mm; diameters above 2500 mm are known for special applications. They are employed, for instance, with spiral housings and without them-free-running-in so-called blower casings. There the air drawn in axially from the outside through the inlet opening exits radially to the outside between the vanes. To reduce undesired noise emission that arises in the operation of radial impellers, either sound-damping (sound-absorbing) measures or constructive measures on the radial impeller itself that exert a noise-reducing effect on the exiting air flow are necessary.

EP 0 848 788 shows a radial impeller in which the outer edges of the vanes comprise a sloped edge inclined towards the axis of rotation and the peripheral sections of the end plates are curved in order to lower the sound pressure in a frequency range of 50-300 Hz.

In the exiting of the air flow from the radial impeller, effects that degrade the efficiency of the conversion of the kinetic energy contained in the flow medium into the desired increase of static pressure arise due to the abrupt widening of the flow cross section. In order to improve this efficiency, static diffuser rings with an impeller cage, as known for instance from EP 1 039 142, are arranged in connection with the radial impeller. Such diffuser rings, however, are difficult to design, decrease available space and are expensive.

SUMMARY OF THE INVENTION

According to a first aspect, the invention provides a radial fan wheel with a top disk comprising an inlet opening and with a bottom disk. The aforementioned disks are joined to one another by way of a vane ring that comprises axially oriented vanes inclined from inside to outside against the direction of rotation. The outer edges of the vanes, running parallel to the axis of rotation, define an effective diameter of the vanes. Outer peripheral areas formed on the top and bottom disks extending past the effective diameter of the vanes define an annular diffusion space having an outside diameter that exceeds the effective diameter of the vanes by up to 25% and whose cross-sectional profile is rectangular or widened outwards in a trapezoidal shape.

An additional aspect pertains to a fan unit with an intake plate having an integrated inlet nozzle and connected via a mount by means of supports to a mount supporting a drive unit. A fan wheel of the above type is arranged on a drive shaft between the drive unit and the inlet nozzle.

An additional aspect pertains to a radial fan arrangement comprising the following: a radial fan wheel with a top disk comprising an inlet opening and with a bottom disk that are joined to one another by way of a vane ring that comprises axially oriented vanes inclined from inside to outside against the direction of rotation, of which the outer edges of the vanes , running parallel to the axis of rotation, define an effective diameter of the vanes (DAs), wherein outer peripheral areas formed on the top and bottom disks extending past the effective diameter of the vanes define an annular diffusion space with an outside diameter (DN) that exceeds the effective diameter of the vanes (DAs) by up to 25% and whose cross-sectional profile is rectangular or widened outwards in a trapezoidal shape; and a zone adjacent radially to the diffusion space and axially to at least one outer peripheral area and comprising no guide elements substantially affecting the pressure and/or velocity profile of a fluid flowing through this zone.

Additional characteristics are contained in the disclosed devices and methods or are obvious to a person skilled in the art from the following detailed description of the embodiments and the appended drawings.

DESCRIPTION OF THE DRAWINGS

Embodiments of the invention will be described for the sake of example and with reference to the appended drawing, in which.

DESCRIPTION OF THE PREFERRED EMBODIMENTS

Figure 1:
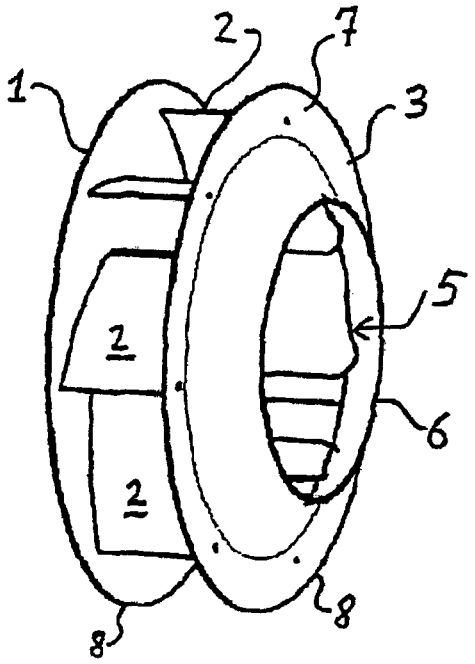
FIG. 1 shows a three-dimensional view of a fan wheel.

FIG. 1 shows a three-dimensional view of a fan wheel. Prior to a detailed description of FIG. 1, various explanations regarding the embodiments will be presented.

For the fan wheels shown herein, an annular diffusion space, in which the exiting fluid flow is smoothed and kinetic energy is converted into static pressure, is formed between the outer peripheral areas of the top and bottom disks. It is particularly easy in terms of design and manufacturing technology for the cross-sectional form of this "diffusion ring" to be given a rectangular shape by increasing the outer diameter of the top and bottom disks appropriately beyond the effective diameter of the vanes. Alternatively, it can be widened outwards in a trapezoidal shape, whereby the diffusion effect is amplified by the additional widening of the cross section and thus the efficiency can be increased and the diameter of the wheel decreased.

In some embodiments, the outer diameter (DN) of the diffusion space (e.g., 16 in FIGS. 2, 4 and 5) exceeds the effective diameter of the vanes (DAs) by 8-20%, preferably 10-15% and, even more preferably, by 12%. These are the diameter ranges in which the aforementioned effect is most pronounced.

In some of the embodiments, the outer peripheral area (e.g., 7 in FIGS. 4 and 5) and a plane normal to the axis of rotation form an angle $\alpha$that is less than 35° and, for instance, less than 25°. The angle $\alpha$is 12°, to cite one example. These are aperture angles at which the desired air conduction is particularly effective and a particularly effective diffusion action is achieved.

In embodiments with a particularly effective design of the fan wheel in the area of air entry, the inlet opening of the top disk is expanded towards the inside in a trumpet shape. In some of these embodiments, the inside edges of the vanes have a convex curvature in the area of connection to the top disk.

In some embodiments the bottom disk (e.g., 1 in FIGS. 1-6) is furnished with a hub arrangement (e.g., 9).

In some embodiments the number of vanes of the fan wheel lies in the range of six to ten vanes.

The angle of contact of the vanes lies, for instance, in the range of 19°-25° and the angle of exit of the vanes lies in the range of 28°-34° (the stated values are inclusive in each case).

The embodiments also show fan units with an intake plate (e.g., 7) with integrated inlet nozzle (e.g., 18) and connected via a mount ( e.g., 19) by means of supports (e.g., 20) to a mount (e.g., 21) supporting a drive unit (e.g., 22), with a fan wheel arranged, according to one embodiment on a drive shaft (e.g., 23) between the drive unit and the inlet nozzle.

Some embodiments pertain to radial fan arrangements in which the radial impeller is used largely free of additional air-conducting elements and, in particular, the air exit area is kept free of such elements. Such a radial fan arrangement comprises, for instance, the following: a radial impeller wheel with a top disk comprising an inlet opening and with a bottom disk joined to one another by way of a vane ring that comprises axially oriented vanes inclined from inside to outside against the direction of rotation, of which the outer edges of the vanes, running parallel to the axis of rotation, define an effective diameter of the vanes (DAs), wherein outer peripheral areas formed on the top and bottom disks extending past the effective diameter of the vanes define an annular diffusion space with an outside diameter (DN) that exceeds the effective diameter of the vanes (DAs) by up to 25% and whose cross-sectional profile is rectangular or widened outwards in a trapezoidal shape; and a zone adjacent radially to the diffusion space and axially to at least one outer peripheral area and comprising no guide elements substantially affecting the pressure and/or velocity profile of a fluid flowing through this zone.

In some embodiments the fan wheels above are used as free-running fan wheels in, for instance, substantially cuboid blower casings. In other embodiments the fan wheels are used in spiral housings.

Returning to FIG. 1, the fan wheel shown is composed of a flat bottom disk 1, a vane ring consisting of several vanes 2 and a top disk 3. Bottom and top disks 1, 3 are arranged concentrically with respect to axis of rotation 4 at a distance B from one another and are joined together via the vane ring. Top disk 3 comprises an inlet opening 5 with a diameter DE, through which air is drawn in operation.

From an upper edge 6 delimiting inlet opening 5, top disk 3 runs, in a trumpet shape opening to the inside, radially into an outer peripheral area 7. Bottom disk I is constructed as a circular disk and bears a centrally arranged hub arrangement 9 with an opening 10 that can be connected to a drive unit in order to power the fan wheel (FIG. 6). In an embodiment not illustrated, the bottom disk and the drive flange can be formed in one piece.

The bottom and top disks are delimited radially by their outer edges 8 and are joined by the vane ring separated from one another by a distance B (driven by an external rotor motor).

Figure 3:
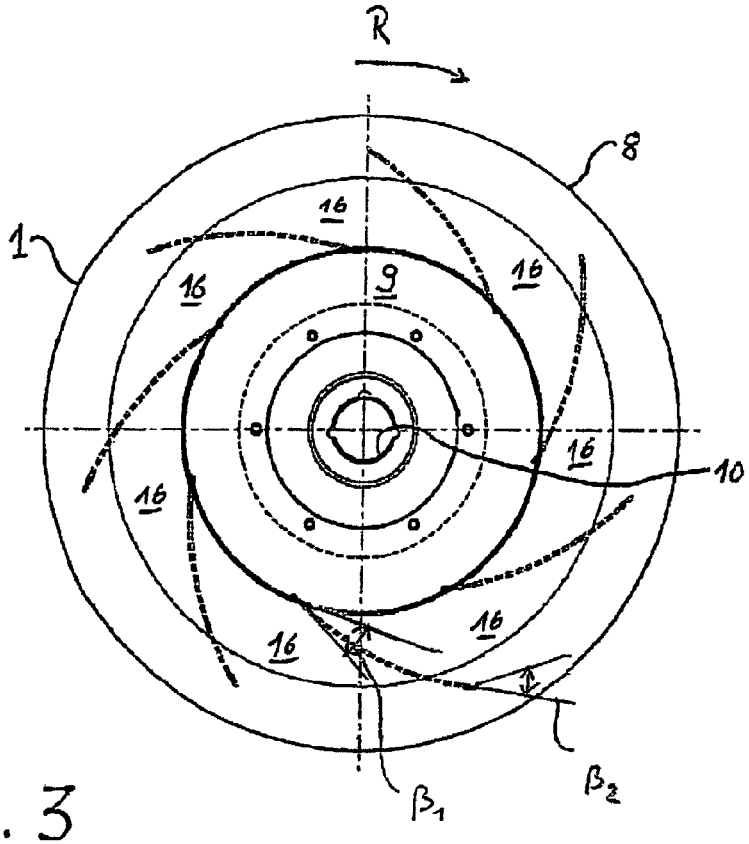
FIG. 3 is a view of the fan wheel onto the bottom disk in the direction of the axis of rotation.

In the embodiment illustrated for the sake of example, the vane ring comprises seven vanes 2 that are arranged in a regular star shape with respect to axis of rotation 4. Inside edges 11 facing axis of rotation 4 define a diameter DSi and outside edges 12 define a vane outside diameter DSa. The vane blade itself runs from inside edge 11 radially and inclined against the direction of rotation R to the outside, where it ends at outer edge 12 (FIG. 3). The axially oriented vanes are additionally curved with respect to axis of rotation 4, with the convex side pointing outwards. Such a fan wheel is also referred to as a backward-curved impeller, furnished in alternative embodiments (not shown) with, for instance, 6-14 vanes, which vanes 2 can also be planar in shape. Their long edges are joined to bottom and top disks 1, 3 in an appropriate matter, the contours of the long edges following the curvature of bottom disk 1 and top disk 3 in the areas of connection, outside and inside edges 12, 11 run substantially parallel to axis of rotation 4, inside edge 11 being curved in the illustrated example in the area of connection to the top disk for technical manufacturing and technical flow reasons.

The angle of contact of the vanes $\beta_1$ (FIG. 3) here is the angle of the tangent at the inside base point of the vanes to the peripheral tangent running through this base point; the angle of emergence of the vane $\gamma[\beta_2]$is correspondingly the angle at the outer base point of the vanes to the peripheral tangent running through this base point. For vanes with an appropriate logarithmic curvature, angles of contact and emergence are equal; for the embodiments shown in the figures, the vanes are less curved, so that the angle of contact $\beta_1$ is smaller than the angle of emergence $\beta_2$.

Bottom and top disks 1, 3 have an outer diameter DN that is greater than the effective diameter DSa of the vanes, so that an outer peripheral area 14 is also defined between outer edge 8 of bottom disk 1 and effective diameter DSa of the vanes. The distance between top and bottom disks 3, 1 or the vane width B is at most $$5(DN-DSa)/2$$

In operation the fan wheel is moved in the drive direction R (FIG. 3) and the vanes transport the fluid in the inside of the fan wheel outwards, where it exits in a substantially radial direction at the effective diameter DSa of the vanes. Air is drawn in from the outside through inlet opening 5 by the negative pressure produced in the interior of the fan wheel. The direction of flow thus runs substantially coaxially through inlet opening 5 into the interior of the fan wheel and is directed outwards radially, with the cross section of the flow continuously expanding. The flow first moves out of space 15 between the vanes at diameter DSa into an annular diffusion space 16 that is defined by the area between outer edges 12 of vanes 2, outer peripheral areas 7, 14 of top and bottom disks 3, 1, respectively, and the outer diameter DN of the corresponding outer edges 8. The design of this area influences the efficiency and noise production of the fan wheel. By virtue of the fact that, after it exits the spaces 15 between vanes, the radial flow is contained axially at both ends by outer peripheral areas 7, 14 before it exits the fan wheel, the Carnot diffuser effect that would appear in case-of immediate release of the flow in the axial direction is avoided. A controlled diffusion into the diffusion space occurs because of the guiding of the air flow according to the invention, i.e., the kinetic energy imparted to the air in the areas 15 between the vanes is converted with low losses into a pressure potential. Expressed in fluid-mechanical terms this means that the kinetic pressure is converted into static pressure. By avoiding the Carnot diffusion, the efficiency increases and the lowering of turbulence at the outlet edges 8 and 12 reduces the noise emission.

Figure 2:
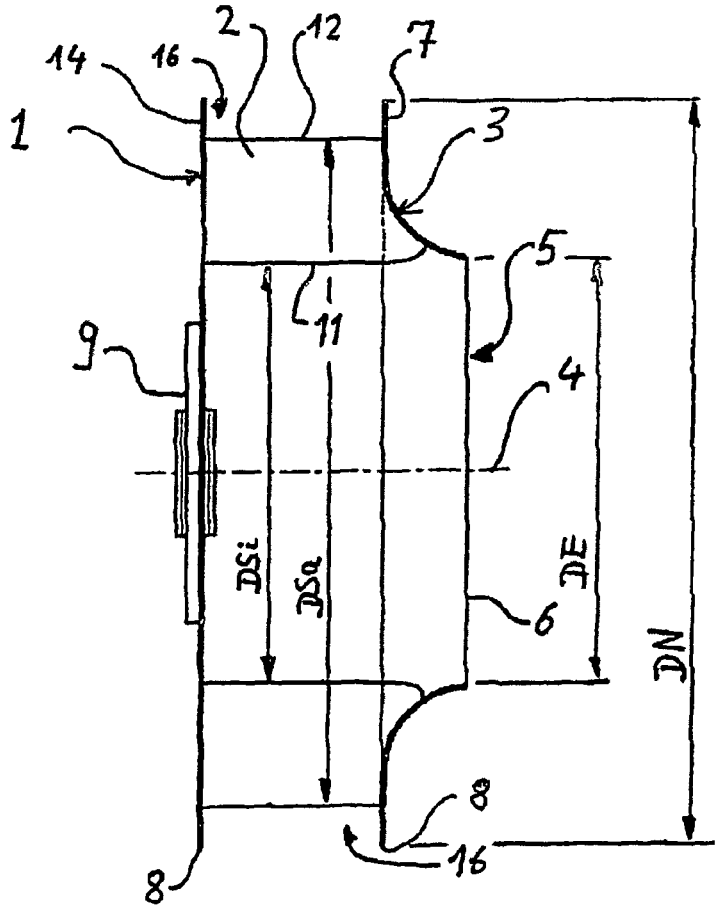
FIG. 2 represents the fan wheel shown in FIG. 1 along the axis of rotation.
Figure 4:
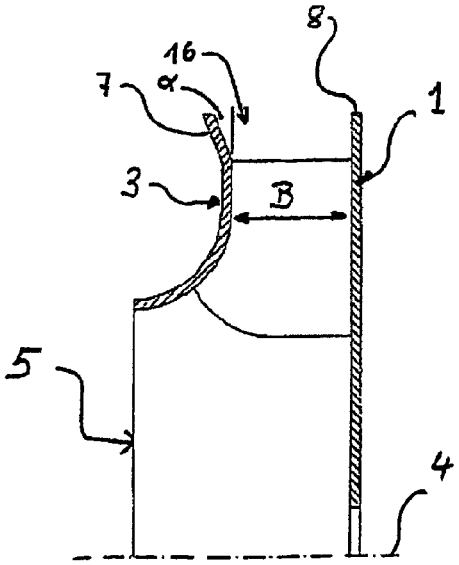
FIG. 4 indicates a design variant of the peripheral area of the fan wheel.
Figure 5:
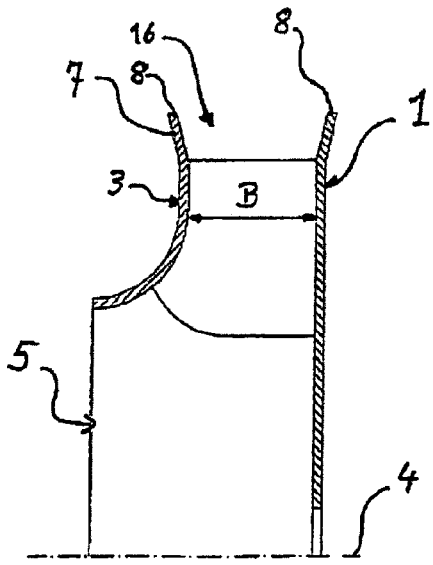
FIG. 5 shows an alternative design variant of the peripheral area.

The designs shown in FIGS. 4 and 5 define a diffusion space of which the cross section is expanded outwardly in a trapezoidal shape, in contrast to the rectangular shape illustrated in FIG. 2. According to FIG. 4, outer peripheral area 7 of top disk 3 is opened outwards by an angle $\alpha$ lying in the range of 0-35°. This additional widening amplifies the diffusion effect and makes it possible to design outer peripheral areas 7, 14 to be narrower, so that outer diameter DN can be only, for instance, 20% more than the effective diameter DSa, or even less; it should be at least 8% larger, however.

FIG. 5 shows a corresponding opening outwards of both outer peripheral areas 7, 14 of top and bottom disks 3, 1. The peripheral outwards opening can, however, also be constructed only on bottom disk 1 (not shown).

Figure 6A:
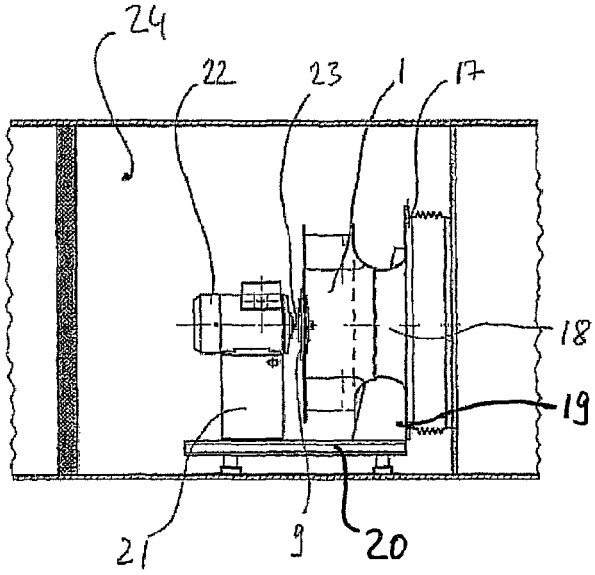
FIGS. 6*a* and 6*b* show an arrangement of a free-running fan wheel in a blower casing in an axial section and a cross section.
Figure 6B:
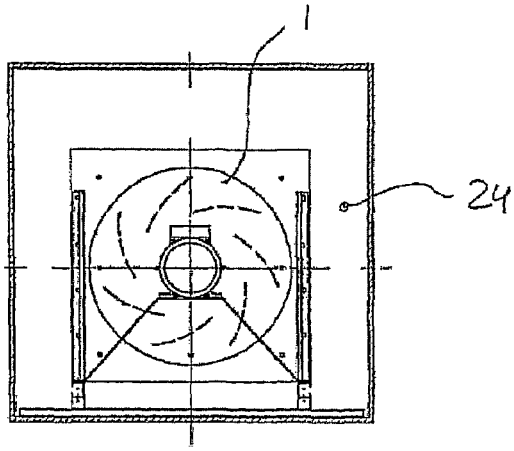

FIG. 6 shows a complete unit in an axial section (FIG. 6*a*) and a cross section (FIG. 6*b*); in addition to the fan wheel described above it also has a suction plate 17 with integrated inlet nozzle 18 that is connected via mounts 19 and supports 20 to a motor mount 21, which in turn supports a motor 22, of which the drive shaft is coupled with hub arrangement 9 of drive shaft 23. This complete unit with a free-running fan wheel is inserted into a substantially cuboid blower casing 24. Inside the latter, he fan unit builds up a pressure that generates volume flows in one or more outgoing channels. Since such blower casings are generally not designed in terms of flow dynamics, the diffusion effect referred to above is particularly effective, since it is possible to dispense with additional flow-directing or sound-damping measures to a large extent. In particular, there are no directional elements such as stationary diffusion rings that are laterally adjacent to diffusion space 16. Moreover, the outward end face of one or both outer peripheral areas 7, 14 is free of directional elements. Fan wheel 1 is not enclosed in a spiral housing inside blower casing 24; the walls of the blower casing are relatively distant radially from the outer peripheral of the fan wheel, i.e., the diffusion space (typically more than 15% of the radius of the fan wheel, thus half the outside diameter DN of the diffusion space) and, at the outside diameter DN of the diffusion space, the fan wheel is free of a housing delimiting the diffusion space in one or both axial directions (that is to say, walls of the blower casing are axially wider than the width of the wheel at the outlet of the wheel).

An efficiency increase of 5% was achieved with a fan wheel having the following dimensions in a free-running arrangement:

Outside diameter DN 457 mm
Effective vane diameter DSa: 406.4 mm
Inside vane diameter DSi: 252.4 mm
Vane width at outlet B: 110.5 mm
Inlet opening diameter DE: 257.4 mm
Angle of contact $\beta_1$: 22°
Angle of emergence $\beta_2$: 31°

The dimensions for other embodiments of fan wheels lie in the following range:

Outside diameter DN 200-1800 mm
Effective vane diameter DSa: 160-1400 mm
Inside vane diameter DSi: 100-650 mm
Vane width at outlet B: 40-280 mm
Inlet opening diameter DE: 98-660 mm
Angle of contact $\beta_1$: 19° -25°
Angle of emergence $\beta_2$: 28° -34°

Figure 7A:
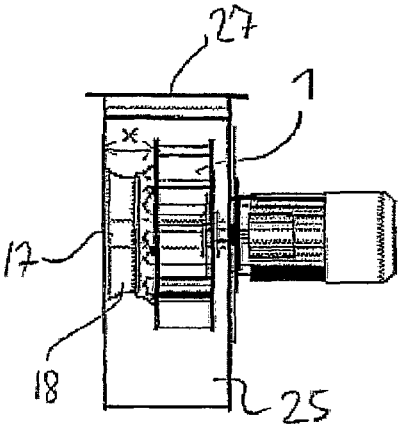
FIGS. 7*a* and 7*b* show an arrangement of a fan wheel (not free-running) in a spiral housing, in an axial section and a cross section
Figure 7B:
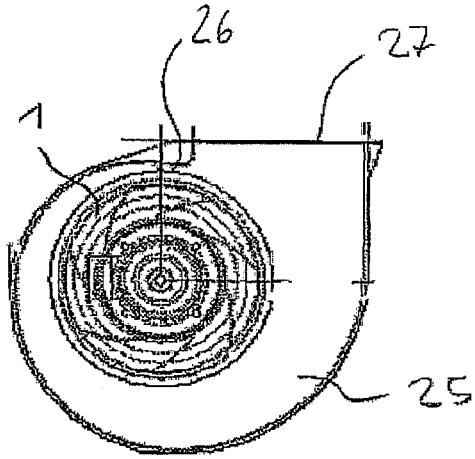

As FIGS. 7*a* (axial section) and 7*b* (cross section show, the fan wheel 1 described above can also be used in conjunction with a spiral housing 25, since the increase of efficiency can also be used in that case. Spiral housing 25 comprises a tongue 26; it is formed by that part of the spiral housing where the radial distance from the fan wheel is a minimum (it is, for instance, less than 15% of the fan wheel radius). Beginning from the tongue, this distance increases (linear or logarithmically, for instance) up to an outlet opening 27. In the axial direction, the spiral housing can directly adjoin the walls of the wheel that form the diffuser space, or it can be arranged a distance x away from these [walls] which distance, for instance, can be less than the width of the wheel at the outlet ( i.e., at the diffuser), as shown in FIG. 7*a*.

Although certain products that were constructed in keeping with the teachings of the invention have been described in this description, the scope of protection of the present patent is not limited thereto. On the contrary, the patent covers all embodiments of the teachings of the invention that fall within the scope of protection of the appended claims, either literally or under the doctrine of equivalents.

The invention claimed is:

1. Radial fan arrangement comprising:

(a) a radial fan wheel, wherein the radial fan wheel is rotatable in a direction of rotation, the radial fan wheel comprising:

(i) a top disk comprising an inlet opening and an outer edge defining a top disk diameter, (ii) a bottom disk comprising an outer edge defining a bottom disk diameter, wherein the top disk diameter and the bottom disk diameter are equal, and (iii) a plurality of vanes, wherein the top disk and the bottom disk are joined to one another by way of the vanes, wherein the vanes extend axially and are inclined from inside to outside against the direction of rotation of the radial wheel, wherein the vanes have inner edges and outer edges, wherein the top disk diameter and the bottom disk diameter each exceed an effective diameter formed by the outer edges of the vanes by 8% to 25%, such that the top disk and bottom disk include respective outer peripheral areas extending radially outwardly past the outer edges of the vanes, wherein the outer peripheral area of the top disk defines a first side wall of an annular diffusion space, and wherein the outer peripheral area of the bottom disk defines a second side wall of the annular diffusion space, with the annular diffusion space including a free space extending axially in between the outer peripheral area of the top disk and the outer peripheral area of the bottom disk, wherein the free space of the annular diffusion space is free of vanes, wherein the side walls of the diffusion space defined by the outer peripheral areas of the top disk and bottom disk are straight in cross section and extend parallel to each other and radially outwardly, wherein a tangent to each vane at its inner edge and a corresponding tangent to a concentric circle at its inner edge together define an angle of contact of 22°, wherein a tangent to each vane at its outer edge and a corresponding tangent to a concentric circle at its outer edge together define an angle of emergence of 31°; and (b) a zone adjacent radially to the diffusion space and comprising no guide elements substantially affecting the pressure and/or velocity profile of a fluid flowing through the zone, the radial fan wheel not being enclosed by a surrounding spiral housing.

2. Radial fan arrangement according to claim 1, in which the outer diameter of the diffusion space exceeds the effective diameter of the vanes by 8% to 20%.

3. Radial fan arrangement according to claim 1, in which the inlet opening of the top disk is expanded towards the inside of the fan wheel in a trumpet shape.

4. Radial fan arrangement according to claim 3, in which the inside edges of the vanes have a convex curvature in the area of connection to the top disk.

5. Radial fan arrangement according to claim 1, in which the bottom disk is furnished with a hub arrangement.

6. Radial fan arrangement according to claim 1, further comprising an intake plate having an integrated inlet nozzle, the intake plate being connected via an intake plate mount by means of supports to a drive unit mount supporting a drive unit, wherein the fan wheel is arranged on a drive shaft between the drive unit and inlet nozzle.

7. Radial fan arrangement according to claim 1, in which the space in which the free-running radial fan wheel is arranged is a climate control blower casing.

8. Radial fan wheel, wherein the radial fan wheel is rotatable in a direction of rotation, the radial fan wheel comprising:

(a) a top disk comprising an inlet opening and an outer edge defining a top disk diameter;

(b) a bottom disk comprising an outer edge defining a bottom disk diameter; and (c) a plurality of vanes, wherein the top disk and the bottom disk are joined to one another by way of the vanes, wherein the vanes extend axially and are inclined from inside to outside against the direction of rotation of the fan wheel, wherein the vanes have inner edges and outer edges, wherein the top disk diameter and the bottom disk diameter each exceed an effective diameter formed by the outer edges of the vanes, such that the top disk and bottom disk include respective outer peripheral areas extending radially outwardly past the outer edges of the vanes, wherein the outer peripheral area of the top disk defines a first side wall of an annular diffusion space, wherein the outer peripheral area of the bottom disk defines a second side wall of the annular diffusion space, with the annular diffusion space including a free space extending axially in between the outer peripheral area of the top disk and the outer peripheral area of the bottom disk, wherein the free space of the annular diffusion space is free of vanes, wherein the side walls of the diffusion space defined by the outer peripheral areas of the top disk and bottom disk are straight in cross section and extended parallel to each other and radially outwardly, wherein a tangent to each vane at its inner edge and a tangent to a corresponding concentric circle at its inner edge together define an angle of contact of 22°, and wherein a tangent to each vane at its outer edge and a corresponding tangent to a concentric circle at its outer edge together define an angle of emergence of 31°.

* * * * *